US008267806B2

(12) United States Patent
Karube

(10) Patent No.: US 8,267,806 B2
(45) Date of Patent: Sep. 18, 2012

(54) GRIP STRUCTURE AND GOLF CLUB

(76) Inventor: Nakaba Karube, Minoh (JP)

( * ) Notice: Subject to any disclaimer, the term of this patent is extended or adjusted under 35 U.S.C. 154(b) by 239 days.

(21) Appl. No.: 12/687,408

(22) Filed: Jan. 14, 2010

(65) Prior Publication Data

US 2011/0092305 A1 Apr. 21, 2011

(30) Foreign Application Priority Data

Oct. 21, 2009 (JP) ..... 2009-242157

(51) Int. Cl.
*A63B 53/16* (2006.01)

(52) U.S. Cl. ..... 473/300

(58) Field of Classification Search ..... 473/300–303, 473/226, 268, 251–255
See application file for complete search history.

(56) References Cited

U.S. PATENT DOCUMENTS 1,587,082 A * 6/1926 Mattern ..... 473/201
2,446,622 A * 8/1948 Turner ..... 69/21
D160,396 S * 10/1950 Karns ..... D21/756
D243,355 S * 2/1977 Spencer ..... D21/756
5,248,141 A * 9/1993 Kelly ..... 473/303
5,348,303 A * 9/1994 Swissheim ..... 473/201
5,865,684 A * 2/1999 Herber ..... 473/201
6,022,278 A * 2/2000 Vela ..... 473/201
6,656,054 B2 * 12/2003 Ulrich ..... 473/201
2002/0082110 A1 * 6/2002 Chen ..... 473/300
2003/0207717 A1 * 11/2003 Ulrich ..... 473/201
2004/0259659 A1 * 12/2004 Enlow ..... 473/300
2005/0049071 A1 * 3/2005 Chuang ..... 473/300
2007/0082750 A1 * 4/2007 Rose ..... 473/300
2007/0238544 A1 * 10/2007 Jazwiec ..... 473/294

* cited by examiner

*Primary Examiner* — Stephen L. Blau
(74) *Attorney, Agent, or Firm* — Westerman, Hattori, Daniels & Adrian, LLP

(57) ABSTRACT

[Subject] The objective is to provide a grip structure that enables a user to certainly grip a grip part at a predetermined position; concurrently, that excels in visual quality and is aesthetically pleasing.

[Resolution Means] Scales 50 are established at predetermined intervals in the axial direction of a grip part 16, for example, on a toe side peripheral part 30 and a heel side peripheral part out of a circumferential surface 28 of the grip part 16, and particularly on the toe side peripheral part 30, the scales 50 are formed with asperity expanding toward a circumferential direction of the grip part 16. This scale 50 functions as a positioning scale and/or an angle adjustment scale. Further, angle adjustment scales 60, 62 and 64 may be established at the lower portion of the grip part 16.

4 Claims, 7 Drawing Sheets

[Fig. 1]
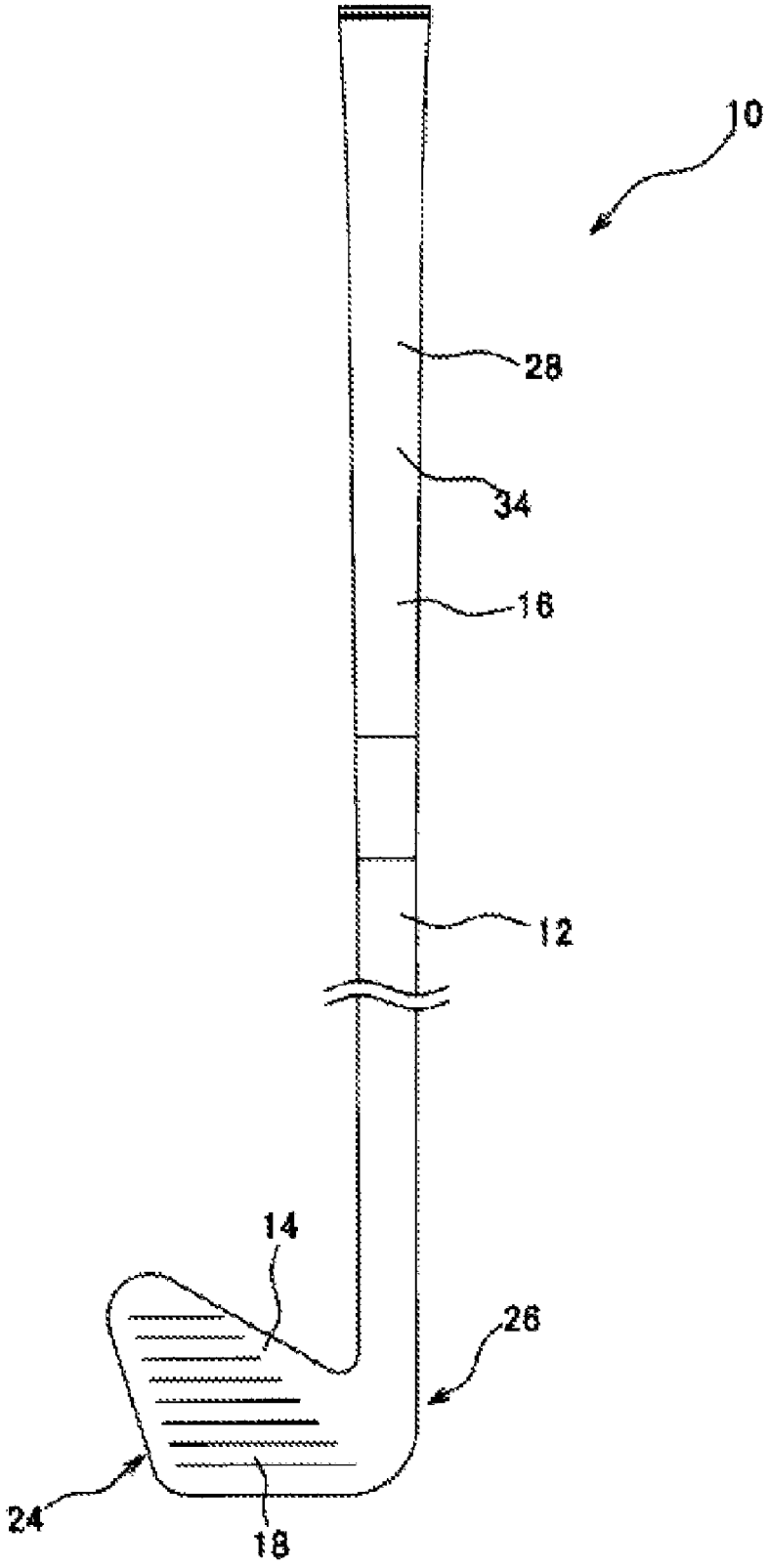

[Fig. 2]
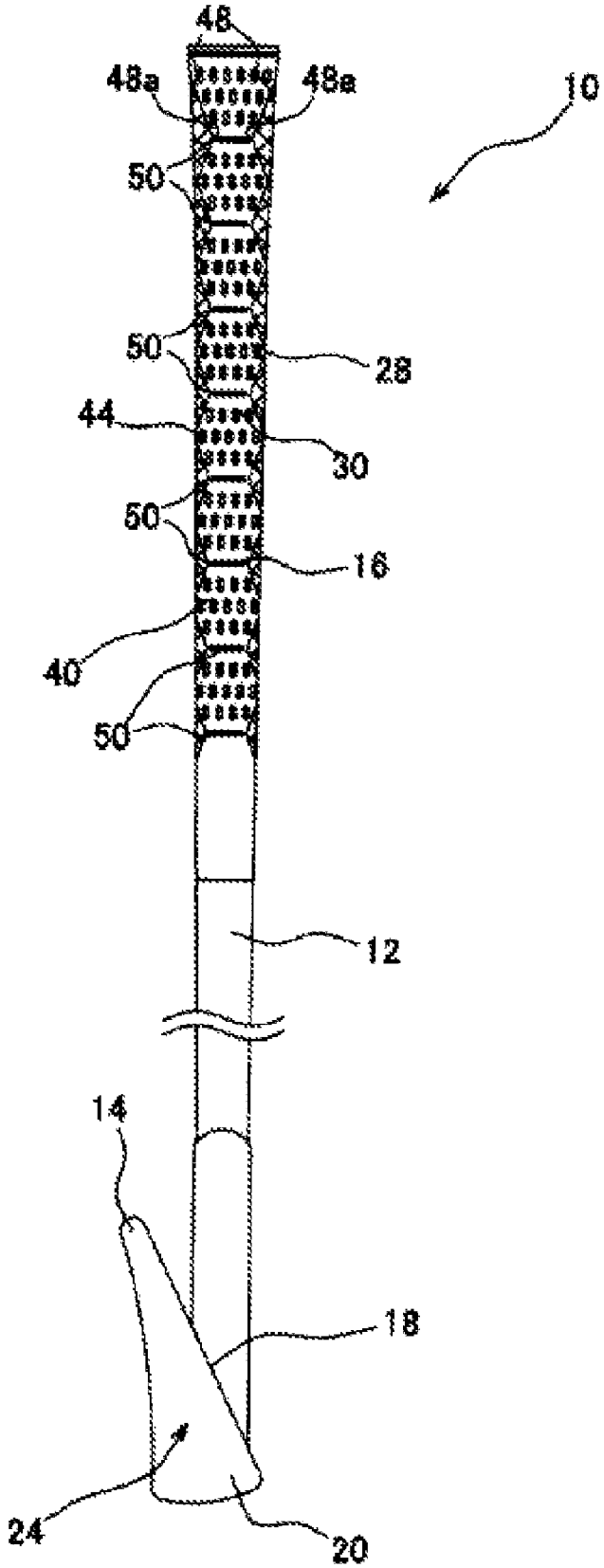

[Fig. 3]
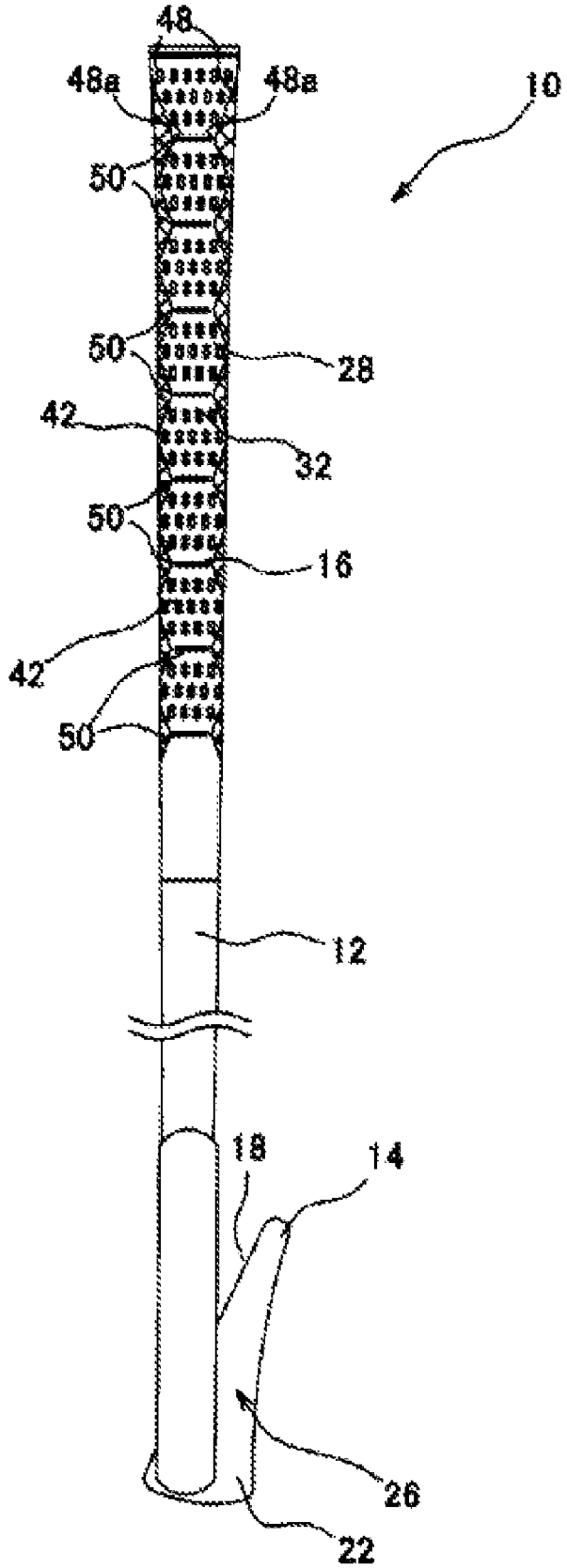

[Fig. 4]
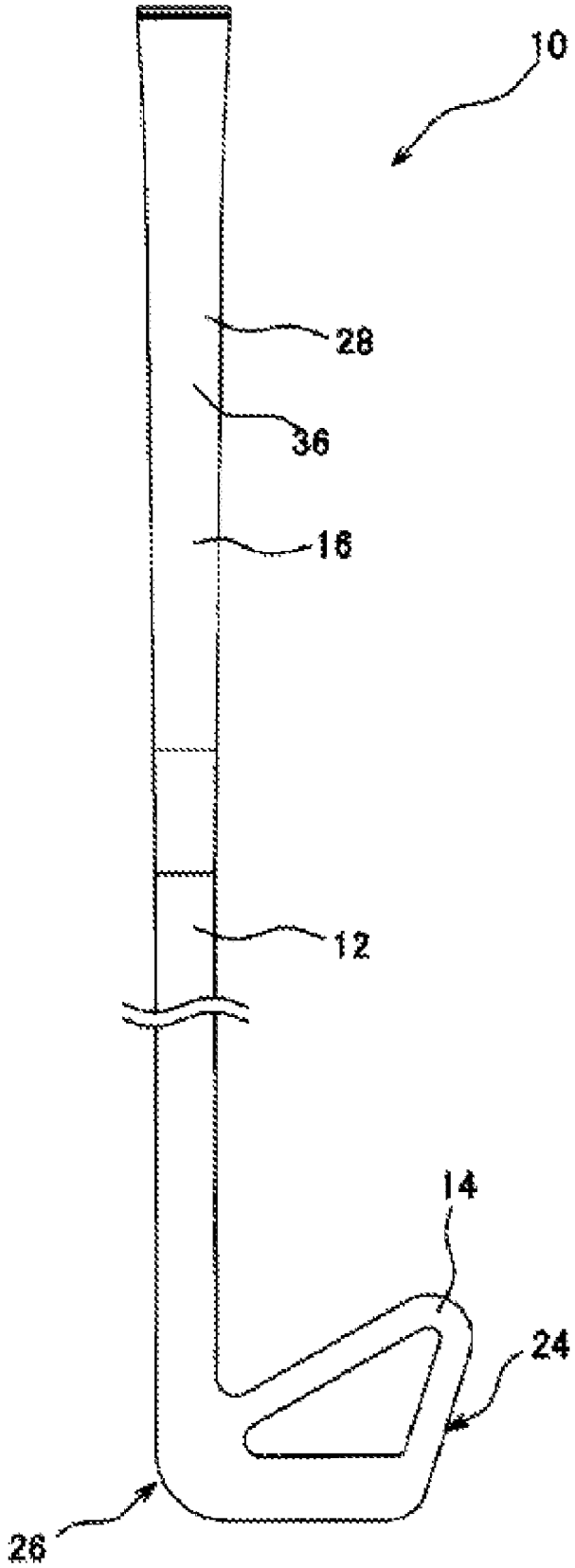

[Fig. 5]
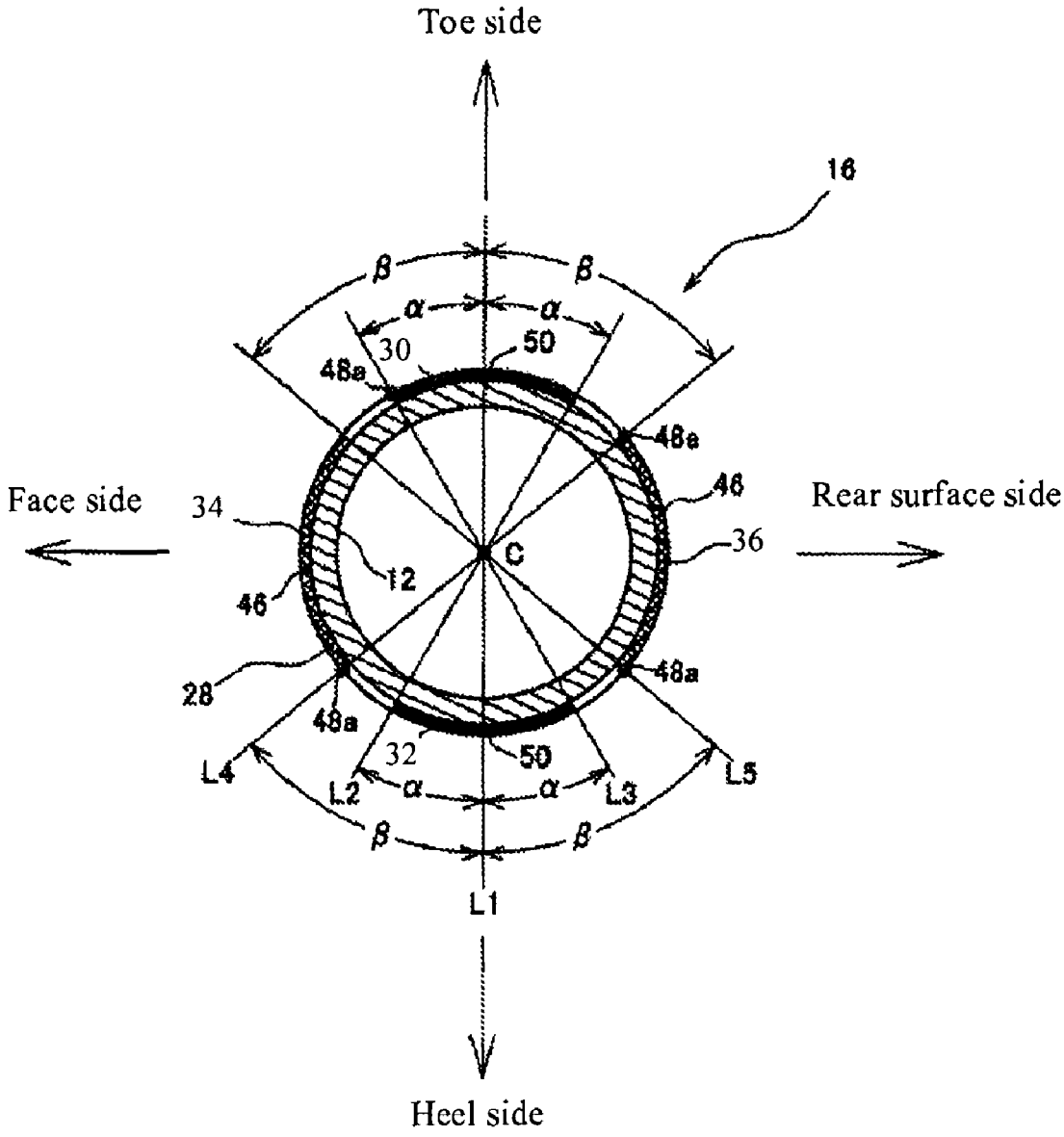

[Fig. 6]
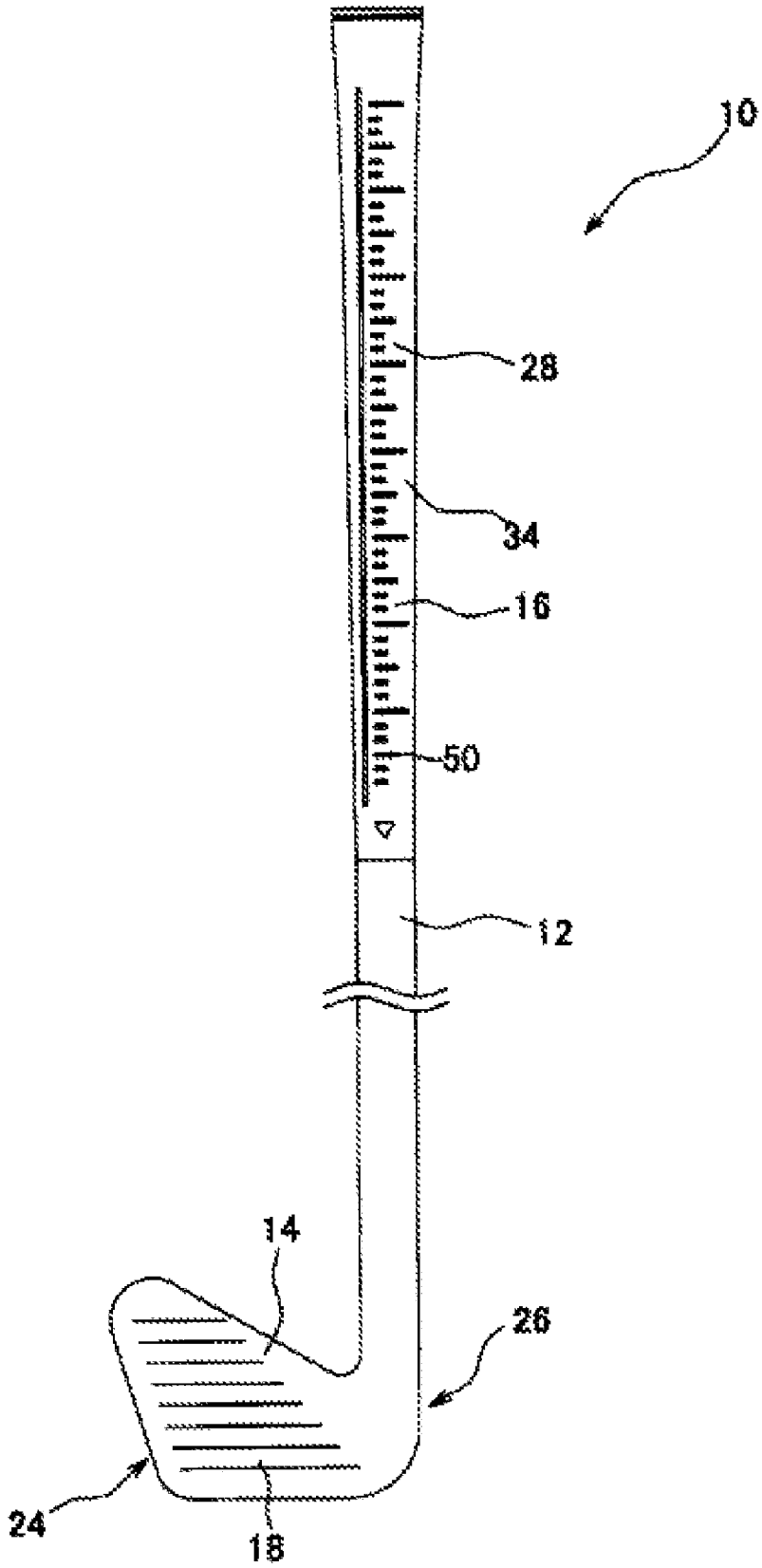

[Fig. 7]
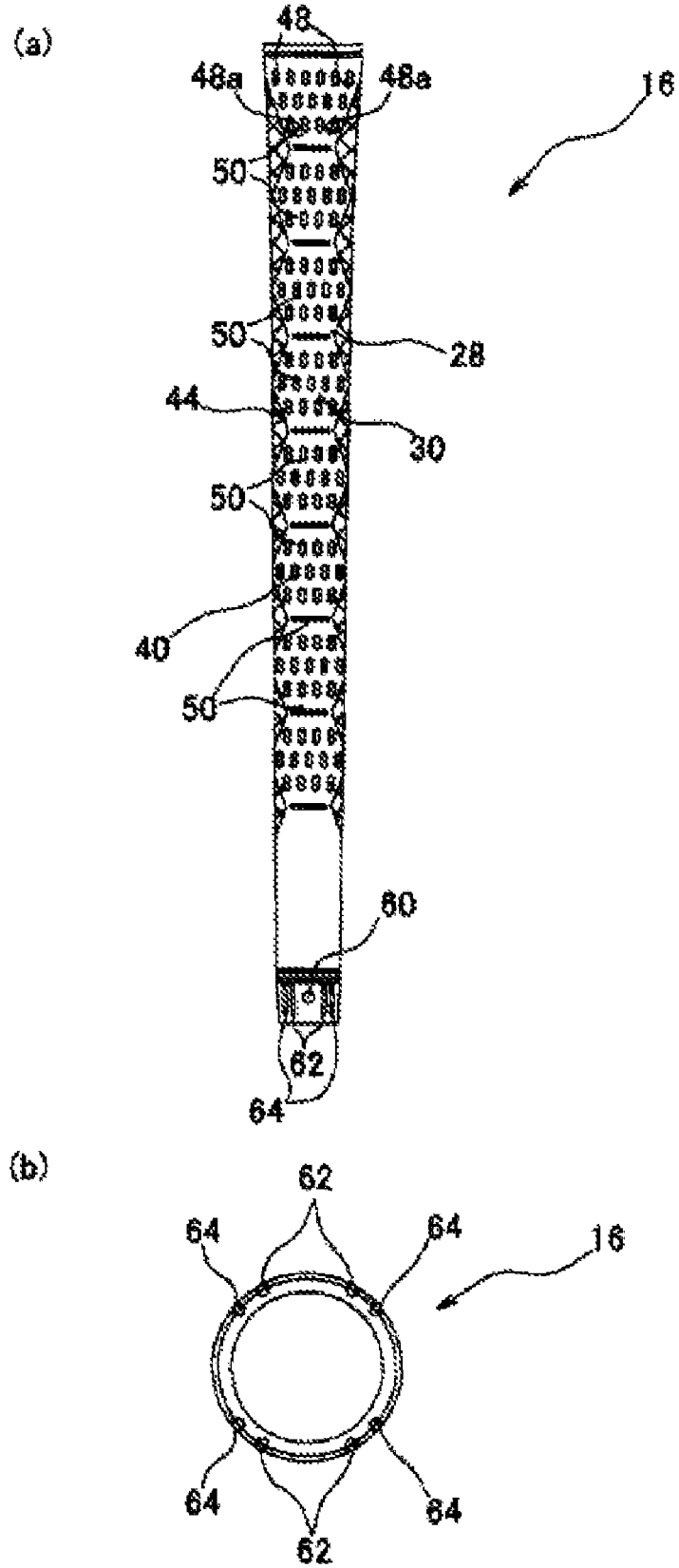

GRIP STRUCTURE AND GOLF CLUB

TECHNICAL FIELD

The present invention relates to a grip structure and a golf club, and it has a special feature in a grip part.

BACKGROUND TECHNOLOGY

Conventionally, many of striking implements used for striking a spherical object, such as a golf club or a tennis racket, are equipped with a grip part. Then, since a grip position of the grip part and how to grip the grip part greatly affect directivity and driving distance of a struck ball, golf clubs having various shapes and structures so as to enable to grip the grip part with appropriate grip position and posture have been provided.

The golf club disclosed, for example, in Patent Literature 1 has a structure to enable to optionally change a connection position between a grip and a shaft, and its shaft length can be appropriately changed according to a request by a user.

Further, the golf club disclosed, for example, in Patent Literature 2 is provided for the purpose of variably striking with emphasis of either directivity or driving distance by changing a grip position even by a non-powerful average player. With this golf club, this objective is attempted to be accomplished by adjusting the length of a grip part established at the rear end of the shaft at 350 mm to 500 mm, and by forming a portion equivalent to the grip part so as to gradually decrease flexural stiffness of the shaft toward the rear end away from the front end of the grip part.

PRIOR ART DOCUMENT

Patent Literatures

[Patent Literature 1] Japanese Unexamined Patent Application Publication H5-92056

[Patent Literature 2] Japanese Unexamined Patent Application Publication H11-42305

SUMMARY OF THE INVENTION

Problem to be Solved by the Invention

The golf club described in Patent Literature 1 enables the adjustment of a shaft to an appropriate length using a marker marked at the top end of the shaft as a rough indicator, and when this golf club is used, the shaft length has to be adjusted every time when changing the directivity or driving distance of a struck ball. Further, even if the shaft length is adjusted, when the grip position is changed, there is another problem where the directionality or driving distance of the struck ball is slightly changed and a desired effect cannot be obtained.

Further, in the golf club described in Patent Literature 2, the length of the grip part is extremely longer than the conventionally-known golf clubs, and markers are established with 1-inch increments in between on a peripheral surface of the grip part to be clearly recognizable with a ring-state chromatic line. Consequently, this golf club has a problem that is inferior in visual quality and is defined. Further, although the grip part is a part where sweat from a user is deposited or that causes friction with hands, the markers by the chromatic line easily disappear due to the effect of sweat or friction, and a function as the markers is impaired soon after start using the golf club.

Further, in the case of appealing only to the eyes, such as the markers in Patent Literature 2, because it becomes ascertained to grip a predetermined position of the grip part only by visual contact, even if the grip is gripped in accordance with the markers, a user swings the golf club without recognizing a change in the gripped position during a period immediately before the golf swing, and it is possible not to obtain a desired effect.

Further, in general, in order to strike a ball to a desired direction and to obtain desired driving distance, it is believed that it is desirable to strongly strike a ball with a face of the club head from the front, but the structure of such grip has not been realized with the technologies described in Patent literatures 1 and 2.

Then, the objective of the present invention is to provide a grip structure to enable a user to certainly grip a grip part at a predetermined position; concurrently, to enable to provide a good-looking and aesthetically pleasing golf club.

Means for Solving the Problem

In order to solve the problems, the present invention provides a grip structure, comprising:

a grip part; and positioning scales established at predetermined intervals in an axial direction of the grip part and at least partially formed with asperity (hereafter, they may be referred to as "positioning scales"), and/or angle adjustment scales at every predetermined angle around a circumferential direction of the grip part (hereafter, they may be referred to as "angle adjustment scales").

The grip structure of the present invention can be a mode including either the positioning scales or the angle adjustment scales as described above, or, another mode including both the positioning scales and the angle adjustment scales, but the mode including both the positioning scales and the angle adjustment scales is preferable. Further, in the grip structure of the present invention, the established scales can function as either the positioning scales or the angle adjustment scales, or they can function as both of the positioning scales and the angle structuring scales.

The grip structure of the present invention is used for striking implements having a striking surface where a spherical object makes contact at the time of striking, and enables to establish asperity parts on a side portion that roughly intersects with the striking surface out of peripheral surface of the grip part.

It is preferable that the grip structure of the present invention has surface grain formed regions where surface grains, which expand toward a predetermined direction, are formed, on the circumferential surface of the grip part;

the asperity is established within the surface grain forming regions; and the direction where the surface grains expand intersects with a direction where the asperity extends.

Further, the present invention provides a golf club equipped with the grip structure.

Since a plurality of positional scales formed with asperity are established in the grip part of the grip structure of the present invention, the grip position can be confirmed not only with a sense of sight but also with a sense of touch. Further, since the positioning scales can be checked with a sense of tough with the grip structure of the present invention, after the grip part is gripped in accordance with the positional scales, if the grip position shifts, this design can easily and certainly remind a user about any shift.

In the grip structure of the present invention, the positioning scales formed with asperity are difficult to disappear as a result from the user's sweat or a frictional effect of hands. Consequently, with the grip structure of the present invention, the function of the positioning scales will never be impaired even if the golf club is used for a long time. Further, the positioning structure established in the grip structure of the present invention can be confirmed not only with a sense of sight but also with a sense of touch, and it is not always necessary to appeal to the eyes by using different color for the grip from other parts as in the conventional ones. Therefore, the establishment of the positional scales as in the conventional ones can prevent impairment of visual quality or aesthetic golf club by adopting the configuration like the present invention.

The grip structure of the present invention is equipped with the positioning scales formed with asperity in a portion orientated toward the side intersected with the striking surface placed for striking a spherical object, in the striking implement for striking a spherical object, and a user can realize whether or not the striking surface is orientated toward a predetermined direction not only with a sense of sight but with a sense of touch in fingers. Consequently, according to the present invention, the grip structure that is supportable by a user so as to optimize not only the grip position but also the orientation of the striking surface and how much the user can delay the orientation of his/her body toward a target direction.

Explaining the present invention by exemplifying a case where the grip structure is applied to a golf club, a club face placed in the club head corresponds to the striking surface and a surface orientated toward a toe side or a heel side corresponds to the side surface. Therefore, when the grip structure of the present invention is adopted to the golf club, the positioning scales formed with asperity shall be established either, or, both on the portion orientated toward the toe side (hereafter, also referred to as "toe side peripheral part") or/and the portion orientated toward the heel side (hereafter, also referred to as "heel side peripheral part").

Consequently, in the golf club equipped with the grip structure of the present invention, whether or not the club head is orientated toward a direction that is appropriate for golf swing can be confirmed according to a sense of a fingertip of a thumb at the toe side or fingertips of other fingers at the heel side in the grip part. Therefore, if the positioning scales formed with asperity are established at the toe side peripheral part or the heel side peripheral part, the user can be assisted so as to optimize not only the grip position but also the golf swing, such as the orientation of the golf club or how much the user can delay the orientation of his/her body toward a target direction.

The grip structure of the present invention can further certainly solve the similar problems by having the configuration where the angle adjustment scales are established in the peripheral direction of the grip at every predetermined angle. In other words, the grip structure enables to shift the grip position of the grip part by a desired angle in the peripheral direction by establishing the angle adjustment scales around the peripheral direction of the grip part. This enables to easily and freely adjust the orientation of the striking surface and how much the user can delay the orientation of his/her body toward a target direction so as to optimize the golf swing.

In the grip structure of the present invention, in addition to the positioning scales, surface grains expanding toward a predetermined direction are established on the peripheral surface of the grip part, and the positioning scales are formed within the surface grain formed region where the surface grains are established. Consequently, in the grip structure of the present invention, the positional scales are not so visually noticeable, and the presence of the positioning scales will not cause disfigurement of the grip part.

Further, in the grip structure of the present invention, since the positional scales formed with asperity are established so as to intersect with the direction where the surface grains established within the surface grain formed regions expand, a user who is about to grip the grip part at the predetermined position can easily distinguish the surface grains from the positioning scales according to a sense of sight and a sense of touch, and he/she can grip the grip part at the desired position.

Further, the grip structure is configured to enable to assist a user so as to stabilize his/her toes at the predetermined positions around the peripheral direction of the grip part, and unlike the conventional one, it is configured to support the toes of the user to be positioned at a predetermined position of the part that is orientated toward the toe side out of the peripheral surface of the grip part, and the fingertips of other fingers to be positioned at a predetermined position of the portion that is orientated toward the heel.

Since the golf club of the present invention is equipped with the grip structure, the golf club excels in visual quality and is aesthetically pleasing, and a user can certainly grip the grip part at a predetermined position.

BRIEF DESCRIPTION OF DRAWINGS

FIG. 1 is a front view showing a state viewing a golf club relating to one embodiment of the present invention from the face side.

FIG. 2 is a side view showing a state viewing a golf club shown in FIG. 1 from the toe side.

FIG. 3 is a side view showing a state viewing a golf club shown in FIG. 1 from the heel side.

FIG. 4 is a rear view of the golf club shown in FIG. 1.

FIG. 5 is a transverse sectional view at a position where scales are established in the grip part.

FIG. 6 is a front view showing a state of the golf club relating to a modified example of the present invention viewing from the face side.

FIG. 7 (*a*) is a side view showing the grip part relating to the modified example of the present invention, and FIG. 7 (*b*) is an A-A cross sectional view.

MODE FOR CARRYING OUT THE INVENTION

Subsequently, a golf club 10 (striking implement) including the grip structure relating to one embodiment of the present invention is explained with reference to drawings. However, the present invention shall not be limited to such embodiment.

As shown in FIG. 1, the golf club 10 has a club head 14 at the tip side of a shaft 12, and has a grip part 16 (the grip structure) at the end side. The shaft 12 is made from a hollow shaft body as similar to the conventionally-known one. The club head 14 is made from similar material to the conventionally-known one.

Specifically, the club head 14 has a club face 18 (a striking surface) for striking a golf ball. Further, as shown in FIG. 2 and FIG. 3, the club head 14 has side surfaces 20 and 22 that roughly intersect with (roughly perpendicular to) the face 18. The side surface 20 is a surface at a toe 24 side of the club head 14, and the side surface 22 is a surface at a heel 26 side.

The grip part 16 is a roughly-columnar part gripped by a user. As shown in FIG. 1 to FIG. 4, a peripheral surface 28 of the grip part 16 is roughly divided into four regions, a toe side peripheral part 30 orientated toward the toe 24 side of the club head 14, a heel side peripheral part 32 orientated toward the heel 26 side, a face side peripheral part 34 orientated toward the face 18 side, and a rear surface side peripheral part 36 orientated toward the rear surface side of the club head 14.

The toe side peripheral part 30 corresponds to a portion where a thumb of a user is placed on the occasion of gripping the grip part 16 with a normal grip way in order to swing the grip part 16. Further, the heel side peripheral part 32 corresponds to a portion where fingertips of other fingers other than the thumb on the occasion of gripping the grip part 16 as similar to that described above. The face side peripheral part 34 and the rear surface side peripheral part 36 correspond to portions where a palm makes contact on the occasion of the gripping the grip 16 as similar to that described above.

As shown in FIG. 2 and FIG. 3, the surface grain formed regions 40 and 42 are placed in the heel side peripheral part 32 and the toe side peripheral part 30. Many of the surface grains 44 are placed in the surface grain formed regions 40 and 42. The surface grains 44 are formed so as to expand toward the longitudinal direction (axial direction) of the grip part 16.

Further, a plurality of scales 50 are established in the surface grain formed regions 40 and 42. The scales 50 are placed from the end side of the grip part 16 to the axial direction of the grip part 16 at predetermined intervals. The scales 50 are formed with asperity expanding toward the direction roughly intersecting with (roughly perpendicular to) the surface grains 44, i.e., toward the circumferential direction of the grip part 16, and [a user] can check the scales not only with a sense of sight but also with a sense of touch.

Herein, as shown in FIG. 5, in the case of assuming a virtual line L1 roughly in parallel to the face 18 passing through the shaft center C of the grip part 16 (particularly lower end line) and virtual lines L2 and L3 inclined in the horizontal direction (face 18 direction, rear surface direction) by a degrees centering on the shaft center C from the virtual line L1, the scales 50 are formed so as to extend in the circumferential direction of the grip part 16 throughout the regions partitioned by the virtual lines L2 and L3 on the peripheral surface 28. Consequently, how much a user can delay the orientation of his/her body toward a target direction at the time of golf swing can be adjusted so as to be consistent by adjusting an angle to grip the grip part 16 in accordance with the end of the scales 50. Therefore, the scales 50 also have a function as angle adjustment scales indicating a grip position (a grip angle) in the circumferential direction of the grip part 16 and how the user's body is orientated toward the direction to a target, such as a cup, in addition to the function as the positioning scales indicating the grip position in the circumferential direction of the grip part 16.

Further, the scales 50 are not particularly colored, but their color is the same as the base color of the grip part 16. Consequently, the scales 50 are not visually noticeable, but a user who is about to grip the grip part 16 at the predetermined position can easily recognize the scales 50 with both a sense of sight and a sense of touch.

In the meantime, as shown in FIG. 1 and FIG. 4, a portion, except for the surface grain formed regions 40 and 42, (hereafter, also referred to as "mesh part" 46) out of regions comprising the peripheral surface 28 of the grip part 16 is embossed to be mesh-like, and has a surface configuration, which is different from those of the surface grain formed regions 40 and 42. Consequently, the face side peripheral part 34 & the rear surface side peripheral part 36 and the heel side peripheral part 32 & the face side peripheral part 34 are clearly different in a sense of touch on the occasion of gripping, in addition to the appearance configuration. Therefore, with the golf club 10, a user can check whether or not the face part 34 is orientated toward the front not only with a sense of sight but also a sense of touch on the occasion of gripping the grip part 16.

As shown in FIG. 2 and FIG. 3, the boundaries between the surface grain formed regions 40 and 42, and, the mesh part 46 is serrated, respectively. Apexes 48*a* of the boundaries 48 exist at the positions adjacent to the scales 50 around the circumferential direction, respectively. Consequently, the apexes 48*a* function as markers (positioning scales) for checking the grip position similarly to the scales 50, respectively.

Further, the interval between the scale 50 and the apexes 48*a* and 48*a* adjacent to the scale 50 in the circumferential direction is roughly the same. Consequently, as shown in FIG. 5, in the case of assuming virtual lines L4 and L5 inclined in the horizontal direction (the face 18 direction, rear surface direction) from the virtual line L1 by β degrees (β>α), the apex parts 48*a* exist at the positions where the virtual lines L4 and L5 and the peripheral surface 28 intersect. Consequently, how to orientate the body toward a target direction at the time of golf swing can be adjusted to be consistent by adjusting the angle to grip the grip part 16 using the apex part 48*a* as a rough indication. Therefore, as similar to the scale 50, the apex part 48*a* also has a function as an angle adjustment scale indicating a grip position (a grip angle) in the circumferential direction of the grip part 16 and how to orientate the body toward a target direction, such as a cup, in addition to a function as the positional scale indicating the grip position in the circumferential direction of the grip part 16.

Since a plurality of scales 50 formed with asperity are established in the grip part 16 adopted to the golf club 10 in this embodiment, the grip position can be checked not only with a sense of sight but also with a sense of touch. Further, in the golf club 10, the scales 50 are established at the positions touched by fingertips on the occasion of gripping the grip part 16 for golf swing.

Therefore, with the golf club 10, after the grip position is adjusted once and the grip part 16 is gripped, if the grip position shifts for some reason by the time of golf swing, the shift can be sensuously noticed to a user, and it can prevent a missed shot before it occurs.

As described above, the scales 50 are formed with asperity, and they will not disappear due to sweat from a user's hands or by an effect of friction with the hands. Consequently, even if the golf club 10 is used throughout a long time, the function of the scales 50 will never be impaired.

Further, the scales 50 are formed with asperity, and the color is the same as other base color of other parts. In addition, the scales 50 are formed within the surface grain formed region 42 where many of the surface grains 44 are formed. Consequently, since the establishment of the scales 50 is not recognized at the first glance, the golf club 10 excels in visual quality and is aesthetically pleasing.

The scales 50 expand toward the circumferential direction of the grip part 16, and they can be distinguished from the surface grains 44 formed so as to extend toward the axial direction of the grip part 16 and both a sense of sight and a sense of touch. Therefore, the scales 50 can be easily recognized by the user of the golf club 10. Further, as described above, how the body is orientated toward a target direction at the time of golf swing can be adjusted to be consistent by adjusting an angle to grip the grip part 16 using the end of the scale 50 expanding toward the circumferential direction or the apex parts 48*a* of the boundary 48 between the surface grain formed regions 40 and 42 and the mesh part 46 as a rough indication.

In the golf club 10, the scales 50 formed with asperity are established on the toe side peripheral part 30 and the heel side peripheral part 32 where fingertips make contact on the occasion of gripping the grip part 16 for golf swing, out of the peripheral surface 28 of the grip part 16, and the scales 50 are not established on the face side peripheral part 34 and the rear surface side peripheral part 36. Consequently, a user can viscerally recognize whether or not the club head 14 is orientated toward a direction that is appropriate for golf swing according a sensation of fingertips on the occasion of gripping the grip part 16.

Furthermore, the structures of the golf club 10 and the grip part 16 shown in this embodiment merely show one embodiment of the present invention, and they can be another embodiment. Specifically, in this embodiment, the configuration where the scales 50 are established both on the toe side peripheral part 30 and the heel side peripheral part 32 was exemplified; however, the present invention shall not be limited to this, and another configuration where the scales 50 are only situated either on the toe side peripheral part 30 or on the heel side peripheral part 32.

In this embodiment, in order for the orientation of the club head 14 to easily be recognizable, as well, an example where the scales 50 are established on the toe side peripheral part 30 and on the heel side peripheral part 32 was exemplified. However, the scales 50 can be established on the face side peripheral part 34 as shown in FIG. 6 or on the rear surface side peripheral part 36, and they can be established throughout the entire periphery of the grip part 16.

Further, in this embodiment, the scale 50 has a function as an angle adjustment scale indicating a grip position (a grip angle) in the circumferential direction in addition to the function as a marker (positioning scale) for checking the grip position in the axial direction of the grip part 16, but the present invention shall not be limited to this, and the scale 50 has either the function as the positioning scale or as the angel adjustment scale. Specifically, the scales 50 may be established throughout a wider range more than the region partitioned by the virtual lines L2 and L3, and they may be established in a narrower region than the section mentioned above. In the case of such configuration, it is possible to separately establish scales and/or markers having a function as the angle adjustment scales. For example, it is possible that the angle adjustment scales are established in a connection member for connecting a grip and a shaft.

Further, for example, as shown in FIG. 7, angle adjustment scales 60, 62 and 64 may be separately established in the circumferential direction on the peripheral surface 28 of the grip part 16 at every predetermined angle. In the example shown in FIG. 7, the angle adjustment scales 62 and 62 are established at positions horizontally shifted by 30 degrees centering on the circular angle adjustment scale 60, and the angle adjustment scales 64 and 64 are established at positions horizontally shifted by 50 degrees centering on the circular angle adjustment scale 60. In other words, the angle adjustment scales 62 and 62 or the angle adjustment scales 64 and 64 are positioned on a line (corresponding to a line perpendicular to the virtual line L1 in FIG. 5) intersecting with a line connecting the shaft center C and the angle adjustment scale 60 horizontally at 30 degrees or 50 degrees. The grip angle and how the body is orientated toward a direction to a target, such as a cup, are further easily adjustable by establishing such angle adjustment scales 60, 62 and 64 separately from the scales 50. In this case, the scales 50 can only have the function as the positioning scale.

Further, a ring-state member with the angle adjustment scales may be attached to a grip or a shaft, and in this case, for example, a ring-state groove is placed either in a grip or a shaft, or, a ring-state member, and ring-state ribs (they can be continuous or discontinuous) are placed in the other one of a grip or a shaft, or, a ring-state member, and the ring-state member may be mounted to a grip or a shaft having turnability.

In this embodiment, as a marker of the grip position, the configuration where only the scales 50 formed with asperity are established was exemplified, but the present invention shall not be limited to this, and another configuration where other markers are established in addition to the scales 50 is also adoptable. Further, in this embodiment, the example where the color of the scales 50 is the same as the base color of the grip part 16 by taking its aesthetic appearance into consideration was exemplified, but it can be further easily viewable by coloring the scales 50. Modes of the positioning scales and the angle adjustment scales can be differentiated. For example, when the positioning scales are established in the entire axis direction of the grip and the entire angle adjustment scales are established at the lower end of the grip, the positioning scales can be formed with asperity and the angle adjustment scales, which are hardly touched by fingers, can be formed with printing (it is needless to say, they can be formed with point-like concave parts or convex parts, or, concave parts or convex parts having length expanding in the axial direction).

In this embodiment, the example where the surface grain formed regions 40 and 42 where many of the surface grains 44 functioning as anti-slip are formed was exemplified, but the present invention shall not be limited to this, and it can be configured such that the surface grain formed regions 40 and 42 are placed at a position off the site where the scales 50 are established. According to such configuration, the scales 50 can be further easily distinguished. Further, in this embodiment, the surface grain formed regions 42 are placed only in the toe side peripheral part 30 and the heel side peripheral part 32, but they can be placed in the face side peripheral part 34 and the rear surface periphery 36, as well.

In this embodiment, the apex parts 48*a* are established in the boundaries 48 between the surface grain formed regions 40 and 42, and, the mesh part 46, respectively, and these apex parts 48*a* function as a marker for checking the grip position in the axial direction of the grip part 16 (positioning scale) and as a marker for indicating the grip position (grip angle) in the circumferential direction (angle adjustment scale) as similar to the scale 50, but the present invention shall not be limited to this configuration. Specifically, the boundary 48 does not have to have the apex parts 48*a*.

The grip part 16 does not have to include the surface grain formed regions 40 and 42 and instead has the mesh parts 46 formed throughout the entire periphery, and may have a flat surface configuration except for the scales 50 without having the surface grain formed regions 40 and 42 and the mesh parts 46. Further, the boundaries 48 between the surface grain formed regions 40 and 42, and, the mesh parts 46 are serrated, respectively, but the present invention shall not be limited to this, and for example, it is possible to have flexural shape to be wave-like.

Further, the boundary 48 may have a shape expanding straight toward the axial direction of the grip part 16. In the case of such a configuration, the function as a marker for checking the grip position in the axial direction of the grip part 16 (positioning scale) is impaired, but it becomes possible to use the boundary 48 as a functional marker for indicating the grip position (grip angle) in the circumferential direction by adjusting the position toward the boundary 48.

In this embodiment, a plurality of scales 50 have all the same length and shape, but the present invention shall not be limited to this and as shown in FIG. 6, scales with different lengths can exist, and scales with different shapes can be mixed.

Further, the scales 50 are placed at constant intervals in the axial direction of the grip part 16, but the present invention shall not be limited to this and the intervals between the adjacent scales 50 can vary at different sites. In addition, the intervals between the scales 50 can be defined with any unit of length, such as millimeters, centimeters or inches.

Further, in the case of positioning scales, the distance from the lower end of the grip can be indicated next to the scales, for example, with numerical numbers or units, such as 1 cm, 2 cm, 3 cm, . . . . In the case of the angle adjustment scales, an angle to the virtual line L1 next to the scales, for example, with numerical numbers or units, such as 5°, 10°, −10°, 15°, −15° . . . . Herein, it was explained indicating the angles with regard to the virtual line L1, but angles with regard to a virtual line L6 (not shown) roughly vertical to the virtual line L1 may be used for scales.

In this embodiment, the golf club 10 was exemplified as one example of a striking implement equipped with the grip part 16 (the grip structure), but the present invention shall not be limited to this and the present invention is applicable to all striking implements having a grip for striking a spherical object, such as a tennis racket or a badminton racket.

[Industrial Applicability]

The grip structure of the present invention is applicable to all articles having a grip, such as a golf club or a tennis racket. Since a grip position can be recognized not only with a sense of sight but also with a sense of touch in the articles equipped with the grip structure of the present invention, the grip position can be easily adjusted so as to be an appropriate position for hitting a spherical object.

[Description of Symbols]

10 golf club (striking implement)
16 grip part (grip structure)
18 face (striking surface)
20, 22 side surface
30 toe side peripheral part
32 heel side peripheral part
40, 42 surface grain formed region
44 surface grain
48*a* apex (positioning scales, angle adjustment scales)
50 scales (positioning scales, angle adjustment scales)
60, 62, 64 angle adjustment scales

The invention claimed is:

1. A golf club grip structure, comprising:

a grip part having surface grains, the grip part having a shaft center extending in an axial direction, the grip part having a first line running at the shaft center extending between a toe side and a heel side, and a second line running at the shaft center, the second line perpendicular to the first line, the second line extending between a face side and a rear surface line, positioning scales formed with asperity provided on the grip part, the positioning scales being located at predetermined intervals in the axial direction of the grip part, the positioning scales being of lines, each of the lines having a predetermined length extending in a circumferential direction of the grip part, and angle adjustment scales at the toe side around the circumferential direction of the grip part, the angle adjustment scales provided lower than the positioning scales, the angle adjustment scales comprising a point, a pair of third lines and a pair of fourth lines, the pair of third lines and the pair of fourth lines extending in the axial direction of the grip part, wherein the point is located on the first line at the toe side, wherein the pair of the third lines are located at 30 degrees with respect the first line, one of the third lines is located at a side of the face side, the other of the third lines is located at a side of the rear surface side, wherein the pair of the fourth lines are located at 50 degrees with respect the first line, one of the third lines is located at a side of the face side, the other of the third lines is located at a side of the rear surface side.

2. A golf club having the golf club grip structure according to claim 1.

3. The golf club grip structure according to claim 1, wherein the angle adjustment scales are provided lower than the surface grains of the grip part via a region without the surface grain.

4. A golf club, comprising:

the golf club grip structure according to claim 1, a shaft; and a connection member for connecting the grip structure and the shaft, wherein the angle adjustment scales are provided on the connection member.

* * * * *